US005771040A

United States Patent [19]

Kim

[11] Patent Number: 5,771,040

[45] Date of Patent: Jun. 23, 1998

[54] DEVICE AND METHOD FOR DISPLAY CENTERING OF THE EFFECTIVE SCREEN OF LCD

[75] Inventor: Tae-Sung Kim, Suwon, Rep. of Korea

[73] Assignee: Samsung Electronics Co., Ltd., Kyonggi-do, Rep. of Korea

[21] Appl. No.: 593,247

[22] Filed: Jan. 29, 1996

[30] Foreign Application Priority Data

Jan. 27, 1995 [KR] Rep. of Korea ..... 1533/1995

[51] Int. Cl.[6] ..... G09G 3/36

[52] U.S. Cl. ..... 345/213; 345/3; 345/132

[58] Field of Search ..... 345/3, 118, 121, 345/125, 213, 132

[56] References Cited

U.S. PATENT DOCUMENTS 4,990,904 2/1991 Zenda ..... 345/3

5,111,190 5/1992 Zenda ..... 345/3

*Primary Examiner*—Jeffery Brier

*Attorney, Agent, or Firm*—Cushman Darby&Cushman IP Group of Pillsbury Madison & Sutro LLP

[57] ABSTRACT

A device and method for centering a display on the effective screen of a Liquid Crystal Display (LCD). A first pulse generator outputs horizontal timing pulses at a first frequency, and a second pulse generator outputs horizontal timing pulses at a second frequency. The first and second pulses are summed according to a data enable signal. A start pulse generator receives the summed pulses and the vertical synchronizing signal and controls the starting line of the display data according to the desired display position on the effective screen, the number of screen lines, and the number of data display lines. Because the device and method utilizes internal timing signals of the display, it is capable of use with any number of screen lines or vertical synchronizing frequency.

16 Claims, 5 Drawing Sheets

Center deflection

Upper deflection

Lower deflection

Center deflection

Main clock
25,175MHz

Vsync

DE

H/2
H

Nr

DEVICE AND METHOD FOR DISPLAY CENTERING OF THE EFFECTIVE SCREEN OF LCD

BACKGROUND OF THE INVENTION

1. Field of the Invention

This invention relates to a device and method for positioning an image on the effective screen of a Liquid Crystal Display (LCD), and more particularly, to a device and method in which any resolution video image can be displayed in the center of an LCD screen, irrespective of the number of screen lines and the vertical synchronizing frequency, by controlling the internal timing signals of the LCD.

2. Description of the Related Art

Although cathode ray tubes (CRTs) have been widely used as screen display devices, recently LCDs have become more widely used, together with rapid developments in thin film transistor (TFT) LCD technologies.

In particular, CRTs have numerous defects such as high power consumption, large volume, heavy weight, harmful electromagnetic waves, and the like, which can be effectively overcome using LCD technologies. Accordingly, there currently is a general tendency to use LCDs in the field of the portable information-processing equipment like notebook computers.

However, although LCDs have many advantages in comparison with CRTs, the former also have disadvantages caused by their inherent characteristics. The disadvantages of using LCDs can be described as shown below.

In general, computer systems have several screen display modes according to the kinds of chip sets used in their graphic cards or the types and number of software applications used by the computer. However, these screen display modes usually have variable frame frequencies, numbers of display lines, polarities of the synchronizing signal, etc.

Using CRTs, although display signals are individually inputted in accordance with each screen display mode, it is possible to display images properly on the screen by controlling a deflection of the electronic beam in the CRT itself. On the other hand, with LCDs, it is impossible to display an image having more lines than the predetermined resolution on the screen because the maximum number of display lines is determined by the characteristics of the LCD itself.

Further, even with screen display modes having resolutions less than that predetermined by the LCD, the displayed portion of the effective screen is deflected toward the lower or upper part of the screen with extra blank lines showing black data. That is, as shown in FIG. 3A or 3B, it is inevitable for the displayed portions to be deflected toward the upper part or the lower part of the effective screen. This is described in further detail below.

FIG. 2 shows pulse signals which control the screen display mode. The signals are outputted from an LCD controller to the LCD panel. In the prior art, it is very difficult to position an image in the center of the effective screen of the LCD panel because it is impossible to modulate the frequency of the gate clock (VCLK) or control the position of the gate start pulse (STV), both of which are important in controlling the image position in the LCD.

Particularly, the number of the gate clocks (VCLK) correspond to the number of gate lines that can be displayed on the screen. Therefore, the higher the frequency of the gate clock (VCLK), the more data can be displayed on the screen. Further, the gate start pulse (STV) determines the starting time of the screen in which the image is displayed and the image becomes displayed after the gate start pulse (STV) is generated.

In the prior art, an image is centered on the effective screen by a method in which data is signalized using a software program and transformed to conform to the number of lines in the LCD. In this method, the upper part or the lower part of the screen is blanked to display black data. This screen treatment method is called centering.

That is, in order to center a displayed image on the effective screen, the LCD controller of the graphic card illustrated in FIG. 1 transforms the image signals using a software program according to the gate clock frequency in the LCD.

However, this conventional method has the following problems: first, the position of the effective screen is always dependent on the graphic card; second, the image signal which is transformed to conform with the number of lines in the LCD panel must be changed by setting up the graphic card in accordance with the screen display mode.

SUMMARY OF THE INVENTION

Accordingly, the present invention has been made in an effort to solve the above-described problems.

It is an object of the present invention to provide a device and method for positioning a display on effective screen of an LCD, irrespective of the number of screen lines and the vertical synchronizing frequency.

To achieve the above and other objects, the driving device of the present invention includes a first pulse generator which outputs horizontal timing pulses at a first frequency, and a second pulse generator which outputs horizontal timing pulses at a second frequency. The first and second pulses are summed according to a data enable signal and used to supply a gate clock. A start pulse generator receives the summed pulses and the vertical synchronizing signal and controls the starting line of the display data according to the desired display position on the effective screen, the number of screen lines, and the number of gate lines. Because the device and method utilizes internal timing signals of the display, it is capable of use with any number of screen lines or vertical synchronizing frequency.

DETAILED DESCRIPTION OF THE INVENTION

The present invention will be described in detail in conjunction with the attached drawings as shown below.

Figure 4:
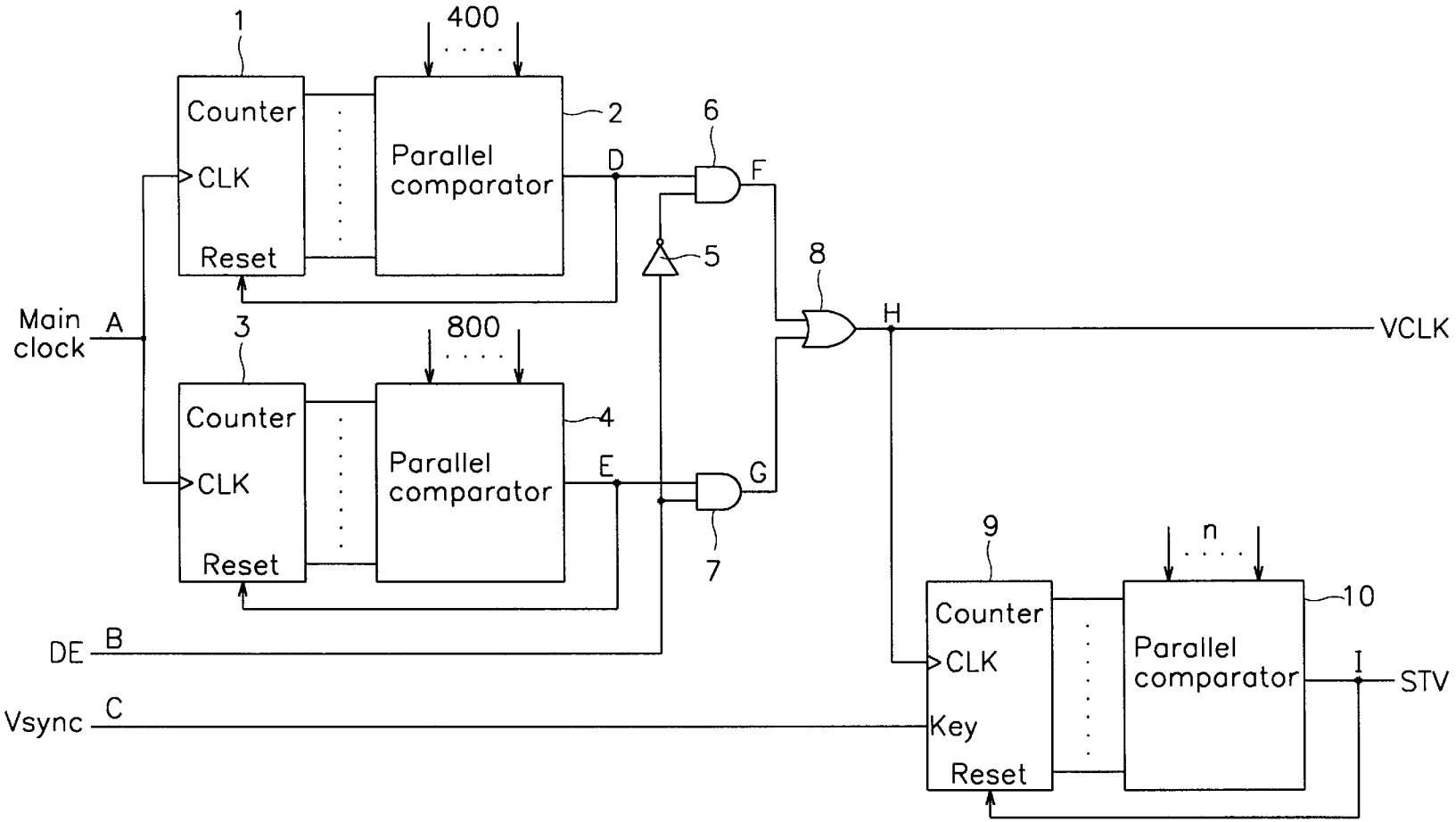
FIG. 4 is a circuit diagram of a device for centering an image on the effective screen of an LCD according to a preferred embodiment of the present invention.

As shown in FIG. 4, a device for centering a display on the effective screen of an LCD according to a preferred embodiment of the present invention includes: a first counter 1 and a second counter 3, the input ports of which are separately connected with the signal line of the main clock. A first parallel comparator 2 and a second parallel comparator 4 have input ports, both of which are separately connected with the output port of the first counter 1 and the second counter 2, respectively. An inverter 5 has an input port which is connected with the data enable signal DE. A first AND gate 6 and a second AND gate 7 have input ports which are separately connected with the output ports of the parallel comparators 2 and 4, respectively. The output port of the inverter 5 is connected to the other input of gate 6. An OR gate 8 has input ports connected with the output ports of AND gates 6 and 7. A third counter 9 has its input port connected with the output port of the OR gate 8 and the line of the vertical synchronizing signal Vsync. A third parallel comparator 10 has an input port which is connected with the output port of the third counter 9.

With the structure of the driving device described above, the operation of a device for centering a display on the effective screen of an LCD and its method will be shown below.

Figure 1:
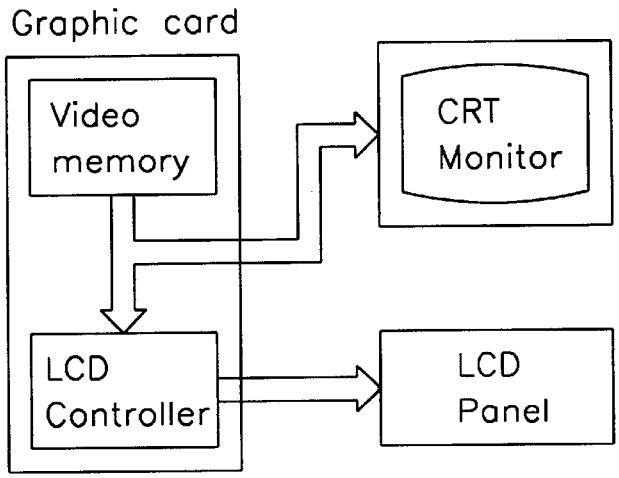
FIG.1(Prior Art)
FIG. 1 is a view of an LCD according to the prior art.
Figure 3A:
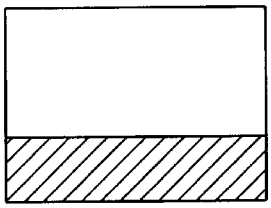
FIGS. 3A to 3C illustrate various positions on which an image is displayed on the effective screen of an LCD according to a preferred embodiment of the present invention.
Figure 3B:
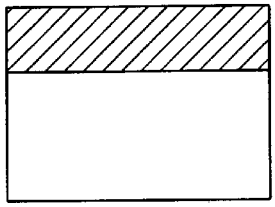
Figure 3C:
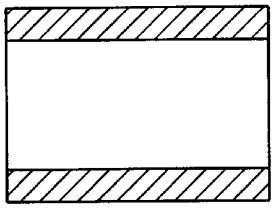
Figure 7:
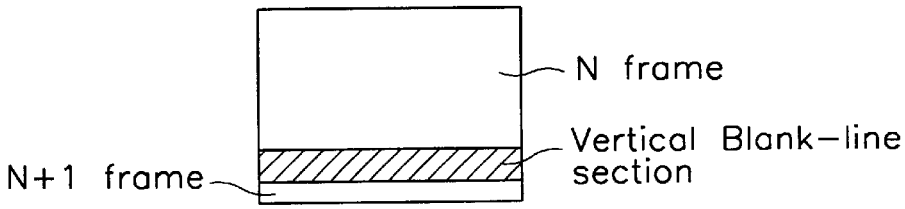
FIG. 7 illustrates a phenomenon of outputting overlapped frames with the next frame data starting on the lower part of the screen.
Figure 2:
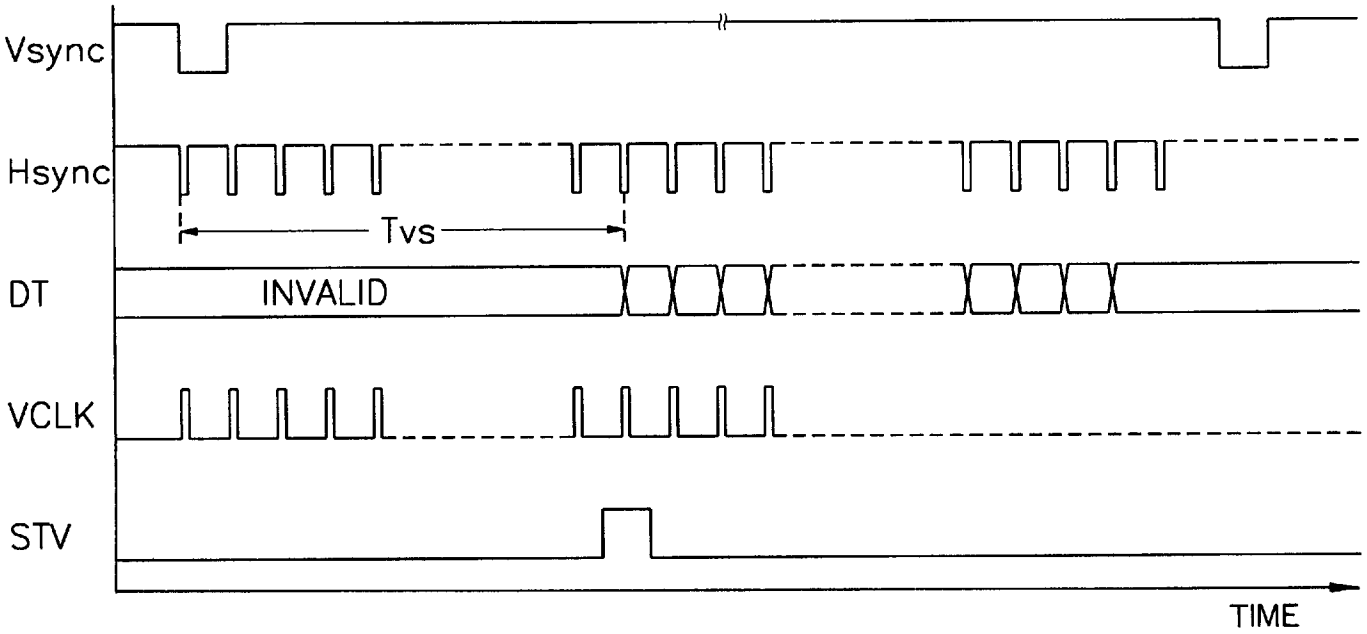
FIG.2 (Prior Art)
FIG. 2 shows timing diagrams of signals in an LCD according to the prior art.

First, for easy appreciation of the present invention, the principles of positioning an image according to the present invention will be described. In order to position a display in the center of the LCD panel as shown in FIG. 3C, the the gate start pulse STV initiates the process of establishing when the LCD panel will begin to scan the data signal DT on the basis of the vertical synchronizing signal, Vsync. The STV signal is generated according to the number of generated gate clocks VCLK as determined by the following formula:

$$\text{Number of gate clocks } (VCLK) = \frac{M-N}{2} \quad (1)$$

in which M indicates number of the maximum display lines (number of screen lines of the LCD panel) and N indicates number of the gate lines, and wherein N is less than or the same as M.

Figure 6:
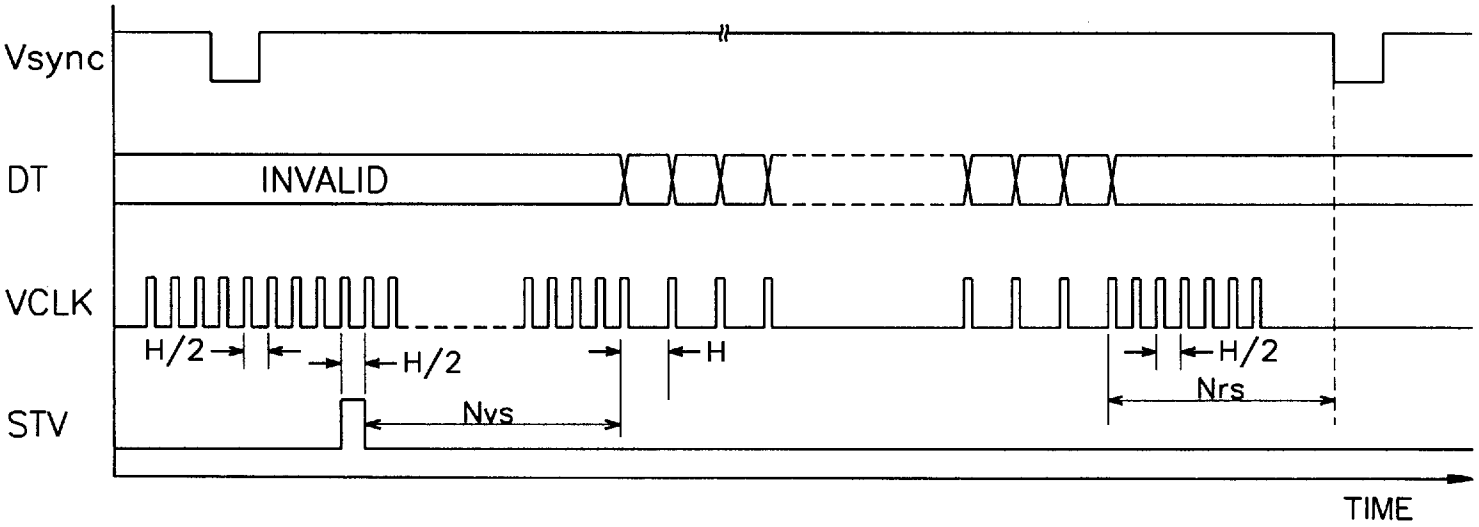
FIG. 6 is a timing diagram showing the principal signals used to control the positioning of an image on the effective screen of an LCD according to a preferred embodiment of the present invention.

FIG. 6 shows timing diagrams showing signals used to center the image on the effective screen of the LCD according to a preferred embodiment of the present invention. In the diagrams, Vsync is a waveform diagram of the vertical synchronizing signal; DT is a waveform diagram of the data signal during one vertical section; VCLK is a waveform diagram of the gate clock, the cycle of which is changed from H/2 to H on the starting point, and then again changed to H/2 on the finishing point; STV is a waveform of the gate start pulse, which is advanced from the data starting point by as much as the Nvs section.

As shown in FIG. 6, after the gate start pulse STV is generated, data signal DT is displayed on the effective screen. The image data represented by data signal DT is offset from the lower part of the screen by the number of lines shown by Nvs and from the upper part of the screen by the number of lines shown by Nvs.

Therefore, the image display position on the effective screen can be determined according to what point in time the gate start pulse STV is output.

However, there are screen display modes where the number of display lines from the time point of generating the vertical synchronizing signal Vsync to the time point of first outputting the data signal DT is smaller than number of the gate clocks VCLK produced by the above formula (1). In such a case, it is impossible to center the image data on the effective screen by simply advancing the gate start pulse (STV) as in the former case.

In the present invention, as shown in FIG. 6, it is possible to correctly position an image on the effective screen to the center of the screen by doubling or more the movable display lines. This is performed in the present invention, for example, by doubling the number of the gate clocks VCLK as required by the formula (1).

That is, as shown in FIG. 6, in order to generate the position of the gate start pulse STV to set the number of display lines Nvs from the time point of the first outputting of the data signal DT, blank data lines are output with double the usual frequency during the time interval between the time point of generating the vertical synchronizing signal and the time point of outputting the data signal DT for displaying the Nvs section. Then, it is possible to display the data image in the center of the screen using the normal cycle of H from display line number Nvs+1. And further, by outputting the gate clock VCLK with double frequency during the time interval from the finishing time point of the data signal DT to the time point of generating the vertical synchronizing signal Vsync of the next frame, the number of blank display lines corresponding to the formula (1) can be output by the black data. In this case, the gate start pulse STV should be controlled by conforming to the gate clock VCLK.

If in an LCD panel having a frequency of 60 Hz as its vertical synchronizing signal Vsync, the data signal DT of the screen display mode is operated with a frequency higher than 60 Hz (for example, 70 Hz), a phenomenon occurs wherein overlapped frames are displayed, with the data of the next frame showing on the lower part of the screen.

Even in this case, in the present invention, each frame of the image screen can be correctly displayed on the center of the screen by controlling the frequency of the gate clock VCLK between the time point of the vertical synchronizing signal and the time point of outputting the data signal DT according to the screen display mode. Further, by controlling the position of the gate start pulse STV it is possible to display the screen with the states indicated in FIGS. 3A and 3B, if so desired.

Figures 5A, 5B, 5C, 5D, 5E, 5F, 5G, 5H, 5I:
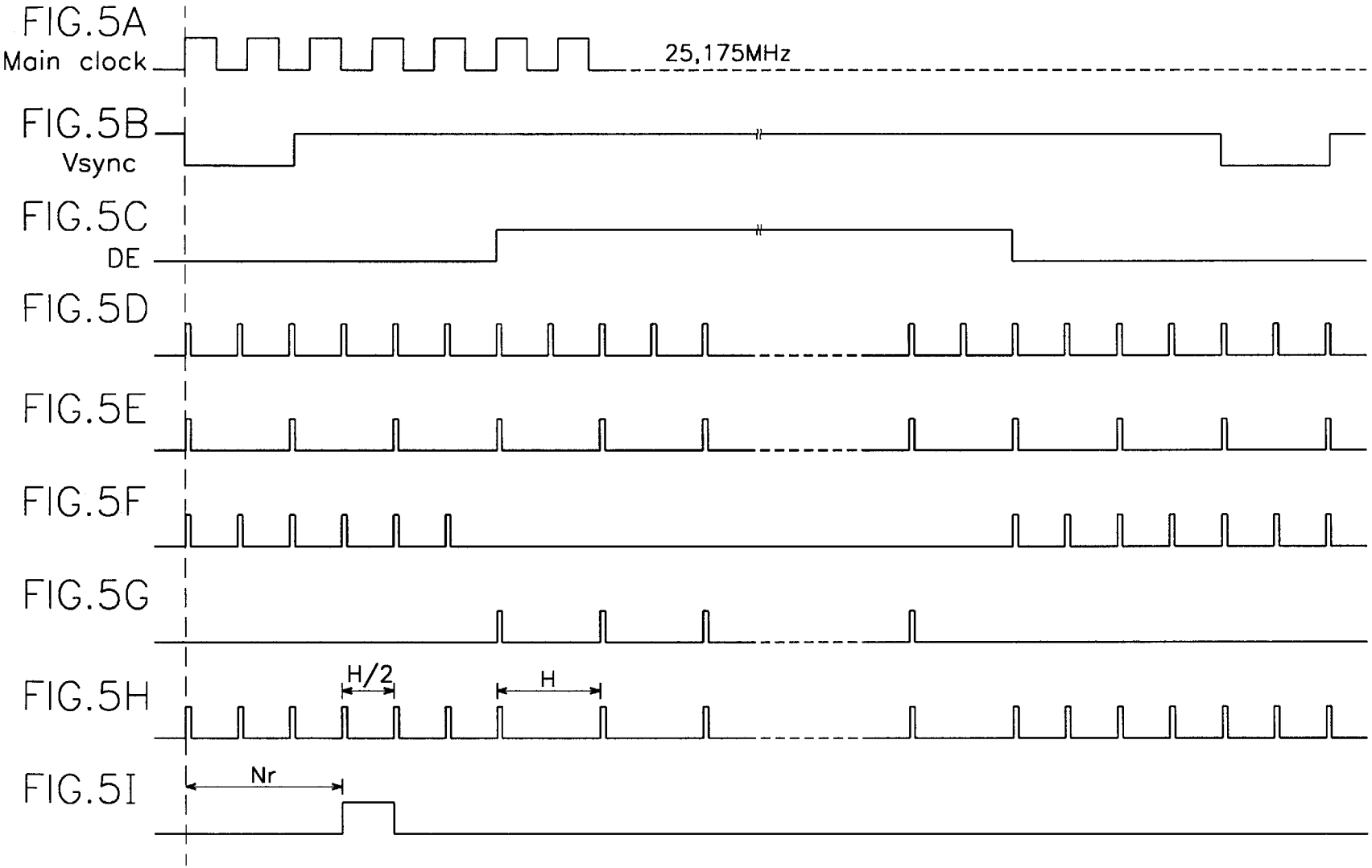
FIGS. 5A to 5I are waveform diagrams of the signals used in a device for centering an image on the effective screen of an LCD according to a preferred embodiment of the present invention.

According to the above principles, the operation of a device for centering the display on the effective screen of LCD according to a preferred embodiment of the present invention can be described in detail as follows. When the device is operating, a main clock having a frequency of 25.175 MHZ like the one illustrated in FIG. 5A is input to the clock ports CLK of the first counter 1 and the second counter 2. In FIG. 5A, one main clock actually means 400 pulses of main clocks, but for the convenience of the graphical representation, 400 pulses of the main clocks is replaced by one cycle of the main clock.

When the main clock is input, the first counter 1 and the second counter 3 count the input clock and output the counted value to the first parallel comparator 2 and the second parallel comparator 4, respectively. The first parallel comparator 2 compares the counted value output from the first counter 1 with the value set-up in itself of 100, and when the two values are identical, the parallel comparator 2 resets the first counter 1 through outputting the pulse signal to the first AND gate 6 and simultaneously outputs it to the first counter 1. Likewise, the second parallel comparator 4 compares the counted value output from the second counter 3 with the value predetermined in itself of 800, and when the two values are identical, the parallel comparator 4 resets the second counter 3 through outputting the pulse signal to the second AND gate and simultaneously outputting it to the second counter 3. The data line from the first counter 1 to the first parallel comparator 2 should have at least 9 bits since the first counter has to be counted by 400 and $2^9$, equal to 512, is a sufficient number to count to 400. Likewise, the data line in the second counter should have at least 10 bits since the second counter has to be counted by 800.

During the period of the first counter's 1 repeated counting outputs, the first parallel comparator 2 generates the clock signal with the frequency like the one illustrated in FIG. 5D, and then applies it to the reset ports of the first AND gate 6 and the first counter 1. During the period of the second counter's 2 repeated counting outputs, the second parallel comparator 4 generates the clock pulse with the frequency like the one illustrated in FIG. 5E, and then applies it to the reset ports of the second AND gate 7 and second counter 3. When the data enable signal DE like the one illustrated in FIG. 5C is in a low state, that is, the output signal of the inverter 5 is in a high state, the first AND gate 6 becomes enabled and together outputs the clock signal input from the first parallel comparator 2 to the OR gate 8. Likewise, when the data enabling signal DE is in a high state, the second AND gate 7 becomes enabled and outputs the clock signal input from the second parallel comparator 4 to the OR gate 8.

As described above, since the inverter 5 reverses a logical level of the data enable signal DE, when the data enable signal DE is in a low state, only the first AND gate 6 outputs the pulse signal like that illustrated in FIG. 5F. Conversely, when the data enable signal DE is in a high state, only the second AND gate 7 outputs the pulse signal like that illustrated in FIG. 5G. Therefore, the data enable signal DE has a role of choosing one of two pulse signals with different frequencies.

As shown in FIG. 5H, the OR gate 8 logically sums the outputting pulse signals of the first AND gate 6 and the second AND gate 7 respectively input in different time periods, and then outputs the summed pulse signal simultaneously with outputting it to the clock port of the third counter 9. The third counter 9 counts the number of the pulse signals input from the OR gate 8 on the basis of the vertical synchronizing signal Vsync, and then outputs the counted value to the third parallel comparator 10. If, after the third parallel comparator 10 has compared the counting value input from the third counter 9 with the value set up in itself (n), the two values are identical, the parallel comparator 10 outputs the gate start pulse STV like the one illustrated in FIG. 5I simultaneously with resetting the third counter 9. In this time, if the third parallel comparator 10 has been set to n, the screen of the LCD panel begins n lines later from the starting point of the vertical synchronizing signal. Therefore, the starting point of the screen can be controlled according to the set value of n. For example n=M−N/2.

As described above, in the present invention it is possible to position an image on the screen of the LCD panel by controlling the gate start pulse STV without being affected by the parallel synchronizing signal.

Also as described above, in the preferred embodiment of the present invention it is possible to provide a driving device and method for centering a display on the effective screen of an LCD and its method by controlling the internal timing signals of LCD, without regard to the number of screen lines of the LCD or the vertical frequency.

Although the present invention has been described above with reference to the preferred embodiment, those skilled in the art will appreciate that various substitutions and modifications can be made thereto without departing from the spirit and scope of the invention as set forth in the appended claims.

What is claimed is:

1. A display driving device which positions an image on a liquid crystal display having a number of screen lines, said display driving device comprising:

a horizontal pulse generator which receives a data enable signal and outputs a gate clock signal having a pulse frequency according to a logic state of said data enable signal, said gate clock signal controlling a start time of each of said screen lines of data displayed on said liquid crystal display; and a start pulse generator which receives said gate clock signal and a vertical synchronizing pulse and outputs a gate start pulse based on said gate clock signal and said vertical synchronizing pulse, said gate start pulse controlling a starting line among said screen lines to begin displaying said image on said liquid crystal display.

2. A display driving device according to claim 1, further comprising:

a first pulse generator which generates a first horizontal pulse signal having a first pulse frequency; and a second pulse generator which generates a second horizontal pulse signal having a second pulse frequency different from said first pulse frequency, said horizontal pulse generator receiving and summing said first and second horizontal pulse signals according to said logic state of said data enable signal to produce said gate clock signal.

3. A display driving device according to claim 2, wherein said first pulse frequency is twice said second pulse frequency.

4. A display driving device according to claim 3, wherein said start pulse generator outputs said gate start pulse such that said image is centered on said liquid crystal display.

5. A display driving device according to claim 4, wherein said start pulse generator includes:

a counter which counts pulses of said gate clock signal received after said vertical synchronizing pulse is received, and outputs a pulse count; and a comparator which compares said pulse count with a start count value, said start pulse generator outputting said gate start pulse when said pulse count equals said start count value.

6. A display driving device according to claim 5, wherein said start count value is determined according to an equation given by:

$$S=(M-N)/2$$

wherein

S is said start count value,

M is said number of screen lines, and

N is a number of gate lines said image.

7. A display driving device according to claim 2, wherein blank data is displayed on said screen lines according to said first frequency and image data is displayed on said screen lines according to said second frequency.

8. A driving device for positioning an image on a screen of a liquid crystal display, comprising:

a first counter and a second counter which count the pulses of a received main clock and output first and second counted values, respectively;

a first parallel comparator which simultaneously outputs a first pulse signal and resets said first counter when said first counted value output from said first counter equals a first predetermined value;

a second parallel comparator which simultaneously outputs a second pulse signal and resets said second counter when said second counted value output from said second counter equals a second predetermined value;

a first logic gate and a second logic gate which receive said first and second pulse signals, respectively, and output said first and second pulse signals, respectively, according to a logic state of a data enable signal;

a summing gate which generates and outputs a gate clock by logically summing said first and second pulse signals from said first and second logic gates, respectively;

a third counter which counts pulses of said gate clock input from said summing gate and outputs a third counted value;

a third parallel comparator which generates and outputs a gate start pulse and simultaneously resets said third counter when said third counted value equals a third predetermined value.

9. The driving device of claim 8, wherein said first logic gate further comprises an inverter which reverses said data enable signal.

10. The driving device of claim 8, wherein said first logic gate and said second logic gate are comprised of AND gate elements.

11. The driving device of claim 8, wherein said summing gate is comprised of OR gate elements.

12. The driving device of claim 8 wherein said second predetermined value is twice said first predetermined value.

13. The driving device of claim 8 wherein said third predetermined value satisfies an equation given by:

$$PV_3 = \frac{M - N}{2}$$

wherein $PV_3$ is said third predetermined value,

M is a number of screen lines, and

N is a number of gate lines in said image.

14. A method of positioning an image on a liquid crystal display having a number of screen lines, said method comprising the steps of:

generating a first pulse signal having a first frequency;

generating a second pulse signal having a second frequency different from said first frequency;

receiving a data enable signal;

generating a gate clock signal on the basis of said first pulse signal and said second pulse signal and a logic state of said data enable signal, said gate clock signal controlling a start time of each of said screen lines of data displayed on said liquid crystal display;

receiving a vertical synchronizing pulse;

determining a starting line among said screen lines to begin displaying said image on the basis of said gate clock signal and said vertical synchronizing pulse; and generating a start pulse to display said image on said starting line of said liquid crystal display.

15. The method according to claim 14, wherein said step of generating said gate clock signal includes the steps of:

determining said logic state of said data enable signal;

outputting said first pulse signal when said data enable signal has a first logic state; and outputting said second pulse signal when said data enable signal has a second logic state.

16. The method according to claim 14 wherein said step of determining said starting line includes the steps of:

counting a number of pulses in said gate clock signal since said vertical synchronizing pulse was received; and comparing said number of pulses with a predetermined value.

* * * * *